US009140087B2

(12) United States Patent
Telfer

(10) Patent No.: US 9,140,087 B2
(45) Date of Patent: Sep. 22, 2015

(54) MODULAR TOOL FOR WELLBORE CLEANING AND METHOD OF USE

(75) Inventor: George Telfer, Aberdeen (GB)

(73) Assignee: M-I Drilling Fluids UK Limited, Aberdeen, Aberdeenshire (GB)

( * ) Notice: Subject to any disclaimer, the term of this patent is extended or adjusted under 35 U.S.C. 154(b) by 869 days.

(21) Appl. No.: 13/294,678

(22) Filed: Nov. 11, 2011

(65) Prior Publication Data

US 2012/0118584 A1 May 17, 2012

(30) Foreign Application Priority Data

Nov. 12, 2010 (GB) ..... 1019164.1

(51) Int. Cl.
*E21B 27/00* (2006.01)

(52) U.S. Cl.
CPC ..... *E21B 27/00* (2013.01); *E21B 27/005* (2013.01)

(58) Field of Classification Search
CPC ..... E21B 27/00; E21B 27/04; E21B 37/08; E21B 43/116; E21B 27/005
USPC ..... 166/99, 311, 377, 301, 98, 164–169
See application file for complete search history.

(56) References Cited

U.S. PATENT DOCUMENTS

| | | | | |
|---|---|---|---|---|
| 2,170,355 | A * | 8/1939 | Stephens | 166/63 |
| 2002/0185878 | A1 * | 12/2002 | Pratt | 294/68.25 |
| 2003/0075940 | A1 * | 4/2003 | Pratt | 294/68.25 |
| 2008/0023033 | A1 | 1/2008 | Potter | |
| 2009/0200012 | A1 * | 8/2009 | Davis et al. | 166/99 |
| 2010/0300690 | A1 | 12/2010 | Al Busaidy | |

FOREIGN PATENT DOCUMENTS

| | | | |
|---|---|---|---|
| CA | 2271620 | A1 | 11/2000 |
| GB | 2441246 | B | 5/2009 |
| GB | 2468972 | A | 9/2010 |

OTHER PUBLICATIONS

Search Report issued in British Application No. GB1019164.1; Dated Jan. 25, 2011 (4 pages).

* cited by examiner

*Primary Examiner* — Kenneth L Thompson
*Assistant Examiner* — David Carroll

(57) ABSTRACT

A sealing means for debris chambers of a debris extraction tool and a method for dismantling and handling a debris extraction toll using such sealing means are disclosed. The sealing means for a debris chamber for a debris extraction tool may include a cylindrical body sealed at one end and open at the other end. The open end may be connectable to an end of the debris chamber. The method for dismantling a debris extraction tool, wherein the debris extraction tool comprises a plurality of connected debris chambers, may use the sealing means and may include connecting the sealing means to the topmost debris chamber of the debris extraction tool.

15 Claims, 6 Drawing Sheets

MODULAR TOOL FOR WELLBORE CLEANING AND METHOD OF USE

BACKGROUND

The technical field of the present invention relates to wellbore cleaning. More particularly, the technical field of the present invention relates to sealing means for debris chambers of a debris extraction tool and a method for dismantling and handling a debris extraction tool using such sealing means.

In recent years, attention has been given to the use of debris extraction tools for wellbore cleaning. GB 2441246B discloses a device and method for retrieving debris from a well using a venturi debris extraction tool and may be useful background art for understanding the present invention. Venturi debris extraction tools are used to create a downhole 'reverse circulation' path to encourage loose debris to be drawn into a collecting chamber. This chamber may be long and requires to be dismantled when pulled from the well. The chamber often contains heavy brine which is considered hazardous on skin contact. A system and/or method for dismantling a debris extraction tool and handle its collecting chamber which would isolate this brine and avoid any skin contact would be advantageous.

In view of the prior art discussed above, there is a need to avoid unwanted fluid (brine) spillage from a of debris extraction tool. This would allow for a cleaner environment and compliance with any regulations in this regard. A further need is to be able to empty the debris extraction tool in a safe and controlled manner.

Additionally, it is desirable to avoid the cumbersome arrangements from a technical and/or economical point of view. Further, it would be an advantage to find a safe and convenient way to handle and lift debris chambers.

SUMMARY

One or more embodiments of the present disclosure may provide means and a method for dismantling a debris extraction tool. This may be achieved by the features of the independent claims. Further embodiments are characterized by the dependent claims.

According to one embodiment, a sealing means for a debris chamber of a debris extraction tool may comprise a cylinder sealed at one end and open at the other end, the open end being connectable to an end of a debris chamber.

According to a further embodiment, the sealing means is an upper sealing means connectable to a top end of a debris chamber of a debris extraction tool, and the upper sealing means prevents debris from exiting the debris chamber when connected to the debris chamber. The upper sealing means may comprise a drain hole and a member within the cylinder for selectively sealing the drain hole. The member may move axially within the cylinder, and the axial movement may selectively seal the drain hole. The member may be moved axially by rotation of the member or by axial movement of the member. The upper sealing means may, when connected to a debris chamber, seal a flow tube within the debris chamber.

According to a further embodiment, the sealing means is a lower sealing means connectable to a lower end of a debris chamber of a debris extraction tool, and the lower sealing means prevents debris from exiting the debris chamber when connected to the debris chamber.

In one embodiment, the sealing means comprises a grip for lifting the upper or lower sealing means.

In one embodiment a system may include any one, or both, of the upper sealing means and a debris chamber connectable with the upper and lower sealing means. The debris chamber may be sealed by the sealing means and contain heavy brine. In one embodiment the system includes that the debris chamber is sealed by the sealing means and any debris in the debris chamber may be drained from the debris chamber with the sealing means connected to the debris chamber.

According to one embodiment a method for dismantling a debris extraction tool is disclosed. The debris extraction tool comprises a plurality of connected debris chambers, using any one, or both, of the upper and lower sealing means according to any one of the previous embodiments.

The method may include the steps of connecting the sealing means to the topmost debris chamber. This step may be done before or after disconnecting the topmost debris chamber from the debris extraction tool.

According to one embodiment a method may further include the step of disconnecting the topmost debris chamber from the debris extraction tool.

According to one embodiment a method may include that the upper sealing means is connected to an upper end of the topmost debris chamber after disconnecting the topmost debris chamber from the debris extraction tool.

According to one embodiment a method may further include the step of connecting the lower sealing means to a lower end of the topmost debris chamber.

These method steps may be repeated during the dismantling of the debris extraction tool so that the content of the plurality of debris chambers is sealed by the sealing means. The sealing means may be used for handling the debris chambers. The sealing means are used to drain the debris chambers. According to embodiments, a method is disclosed that isolates and handles brine in a debris extraction tool using any one, or both, of the sealing means according to the embodiments above. In this way technical problems, such as sealing and handling at the same time, are efficiently achieved.

By sealing the top or the top and the bottom of a debris chamber the above mentioned disadvantages can be overcome. Each debris chamber can be dismantled from the string without any spillage of hazardous fluids, such as brine. Hereby hazardous fluids are prevented from spillage on the rig floor and from making contact with rig personnel. The sealing means may be used for this purpose. The sealing means may also be used to lift and handle debris chambers.

Other technical advantages of the present disclosure will be readily apparent to one skilled in the art from the following description and claims. Various embodiments of the present application obtain only a subset of the advantages set forth. No one advantage is critical to the embodiments. Any claimed embodiment may be technically combined with any preceding claimed embodiment(s). The words "upper" and "lower" are in relation to the orientation of a debris chamber in a debris extraction tool in a wellbore.

BRIEF DESCRIPTION OF DRAWINGS

The accompanying drawings, which are incorporated in and constitute a part of the specification, illustrate embodiments of the invention, and together with the general description given above and the detailed description of the embodiments given below, serve to explain, by way of example, the principles of the invention.

DETAILED DESCRIPTION

Figure 1:
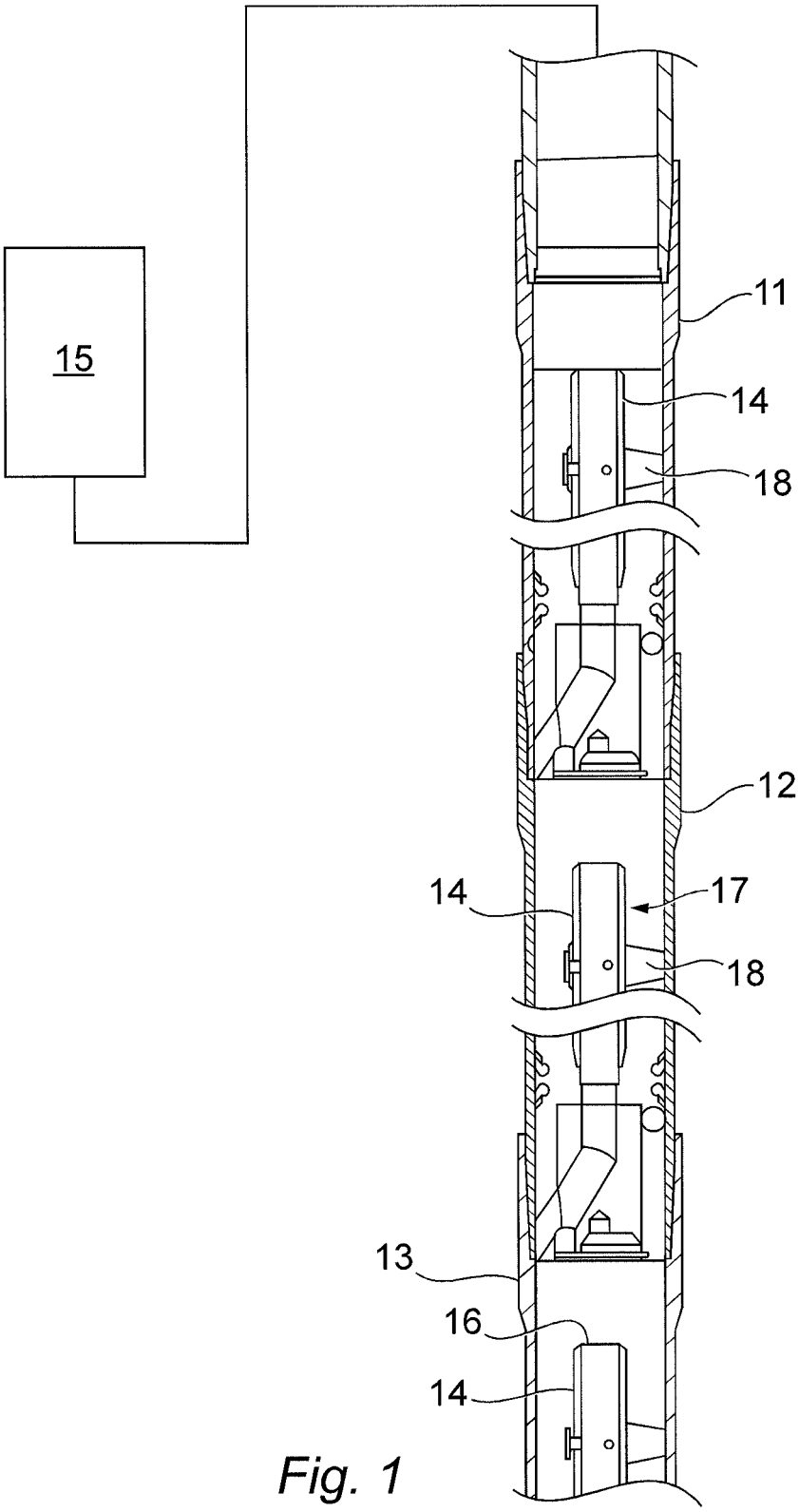
FIG. 1 shows an exemplary embodiment of a plurality of debris chambers.

FIG. 1 illustrates an exemplary embodiment of a debris chamber. Such a debris chamber may be part of a debris extraction tool, and especially a venturi debris extraction tool. The illustrated embodiment is longitudinal half-sectional views of a first debris chamber 11 connected to a second debris chamber 12 connected to a third debris chamber 13. These debris chambers 11-13 may be modular. The first debris chamber 11 is the upper debris chamber when considering the debris chambers 11-13 as part of a debris extraction tool positioned within a well. The third debris chamber 13 is the lower debris chamber when considering the debris chambers 11-13 as part of a debris extraction tool positioned within a well. Any suitable amount of debris chambers may be used. The lowest debris chamber may be connected to a bottom sub for extracting debris. The upper debris chamber may be connected to a debris screening module which in turn may be connected to an engine module 15 schematically indicated in FIG. 1. Such an engine module 15 may operate according to the venturi principle for circulating fluid for the debris extraction tool.

The debris extraction tool may be utilised for retrieving debris from a well, which may comprise part of a tool or tool string located in a borehole, or junk typically found downhole. The debris extraction tool may therefore be utilised in a "fishing" operation, to retrieve part of a tool which has become lodged and stuck in a casing of a borehole. The debris extraction tool may also be utilised for retrieving other debris such as cement lumps, rocks, congealed mud, oxidation lumps, metal debris, scale, slivers, shavings, burrs, water, dislodged mud cake residue, drill cuttings or the like which has accumulated in the casing of a borehole, and which is to be cleaned and removed prior to completion of a well. The debris chambers may collect fluid, such as brine, comprising such debris.

When in operation, the debris extraction tool moves fluid, brine, within the debris chambers. Debris may consequently be collected in the debris chambers 11-13. The debris chamber 11, 12, or 13 in the exemplary embodiment in FIG. 1 comprises an inner flow tube 14. The inner flow tube 14 may be centrally arranged within the debris chamber 11, for example, positioned concentric within the debris chamber 11 in the axial direction of the debris chamber 11.

The fluid moves up through the debris extraction tool, up through the debris chambers 11-13. When the fluid moves through a debris chamber, the fluid may move through the inner flow tube 14. When fluid comprising debris exits a top end opening 16 of the inner flow tube 14, the velocity of the fluid slows and this allows the debris to fall into a bucket 17 of the debris chamber.

Figure 2:
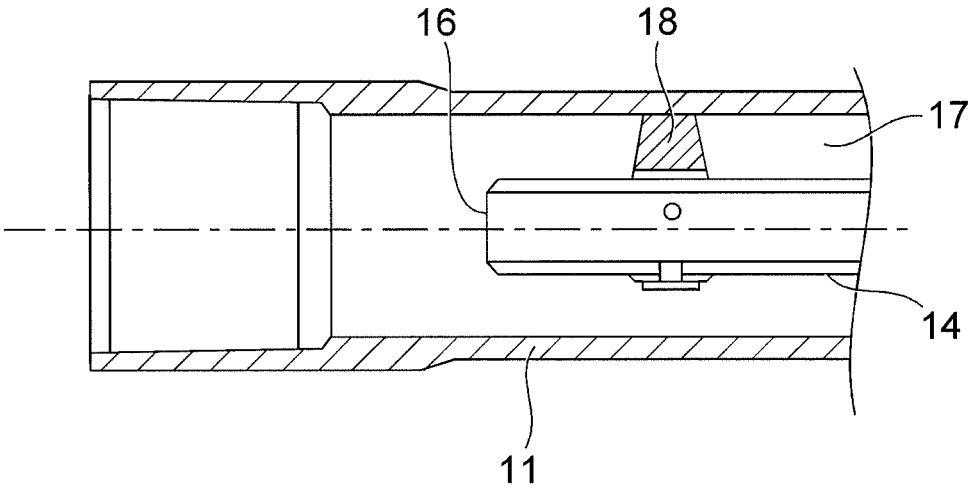
FIG. 2 shows an exemplary embodiment of an upper end of a debris chamber.

Turning to FIG. 2, an exemplary embodiment of an upper end of a debris chamber 11 is illustrated. The top end opening 16 of the inner flow tube 14 ends within the bucket 17. An inner tube positioner 18 holds the inner flow tube 14 within the debris chamber 11.

Figure 3:
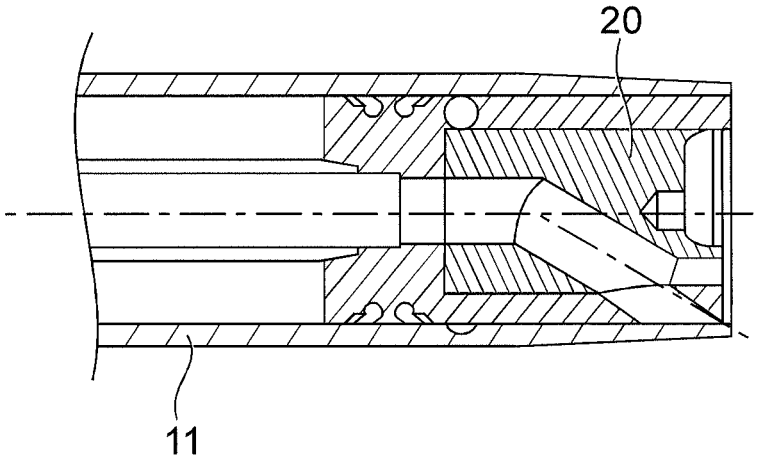
FIG. 3 shows an exemplary embodiment of a lower end of a debris chamber.

FIG. 3 illustrates an exemplary embodiment of a lower end of a debris chamber 11. A deflector 20 may deflect fluid flow from the top end opening 16 of the inner flow tube 14 of a subsequent modular debris chamber and may ensure that debris carried in the fluid of the inner flow tube 14 of a subsequent modular debris chamber falls out into each bucket 17, respectively, when the modular debris chamber 11 is connected with the subsequent modular debris chamber 12.

To avoid any spillage of hazardous fluids the debris chambers are modularized in such a way that they can be dismantled from the string without any spillage of hazardous fluids.

According to an embodiment, the debris chambers may be modularized in such a way that they can be dismantled from the string and handled without any spillage of hazardous fluids. This may be done by providing sealing means for the debris chamber. In one embodiment the sealing means may be a cylindrical body sealed at one end and open at the other end. The open end may be connectable to an end of the debris chamber. The sealing means may be provided with handling means to facilitate handling of the debris chamber with debris in it.

Figure 4:
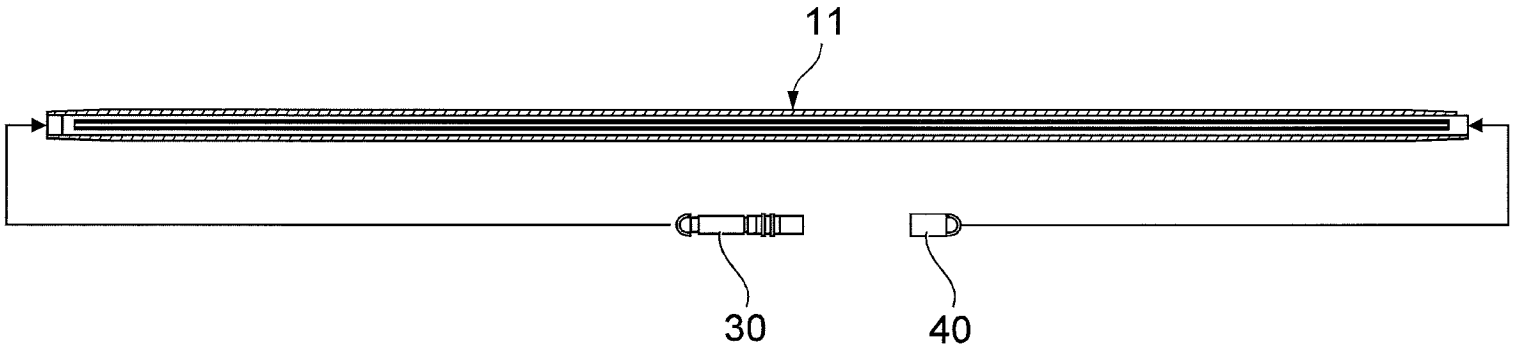
FIG. 4 shows an exemplary embodiment of a debris chamber and sealing means.

FIG. 4 shows an exemplary embodiment of a debris chamber 11 and sealing means 30 and 40. The sealing means 30 and 40 are connectable to the ends of the debris chamber 11. According to one embodiment, an upper sealing means 30 may be connectable to the top end of the debris chamber 11. According to one embodiment, a lower sealing means 40 may be connectable to the lower end of the debris chamber 11. Upper and lower are in relation to the orientation of the debris chamber in a debris extraction tool in a wellbore. The upper end of the debris chamber 11 is to the left in FIG. 4 and the lower end is to the right in FIG. 4.

Figure 5:
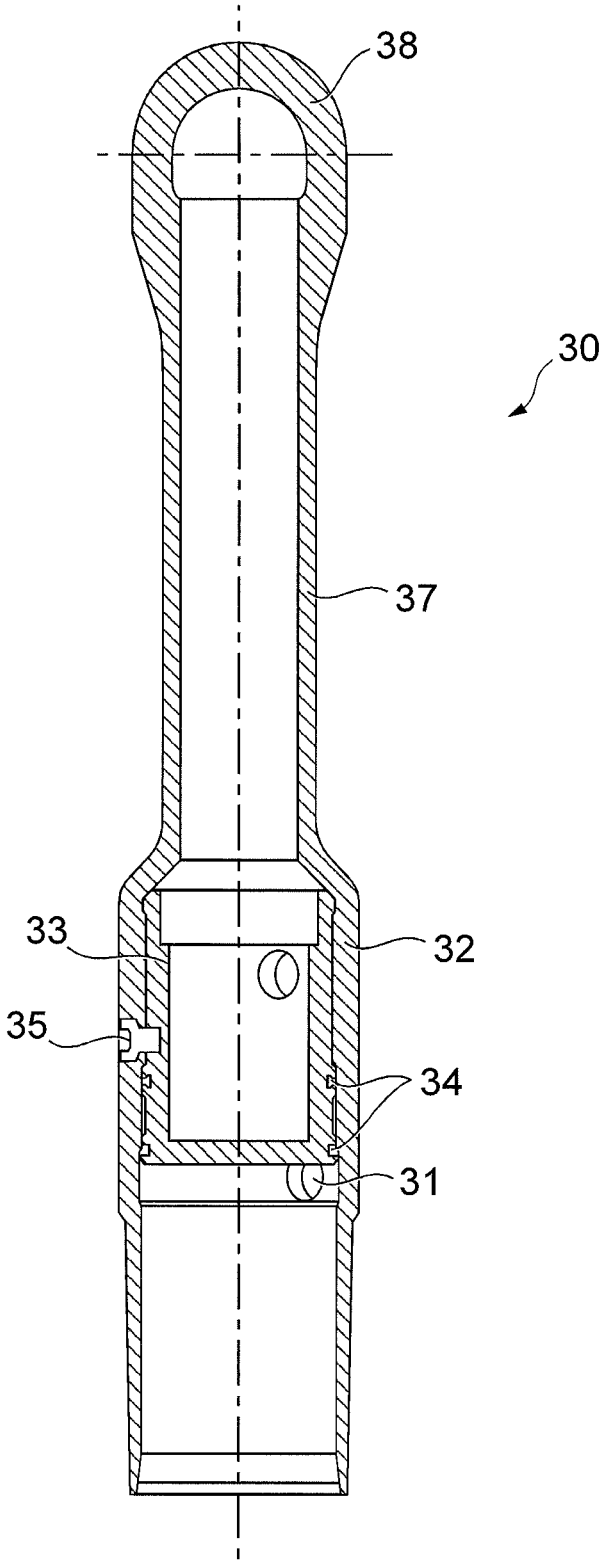
FIG. 5 shows an exemplary embodiment of an upper sealing means.

FIG. 5 shows an exemplary embodiment of an upper sealing means 30. This embodiment includes a cylindrical body 32 sealed at one end and open at the other end, the open end being connectable to a top end of the debris chamber 11. The upper sealing means 30 may prevent debris from exiting the debris chamber when connected to the debris chamber.

According to one embodiment, the upper sealing means may include a drain hole 31 and a member 33 within the cylindrical body 32 for selectively sealing the drain hole 31. According to one embodiment, the drain hole 31 may be located in the cylindrical body 32. The member 33 may move axially within the cylindrical body 32. Such axial movement may selectively seal the drain hole 31. Seals, for example in the form of o-rings 34, may be provided between the member 33 and the cylindrical body 32 to seal the drain hole 31. According to one embodiment, the member 33 may move axially by rotation. According to one embodiment, the member 33 may move axially by linear movement.

Figure 6:
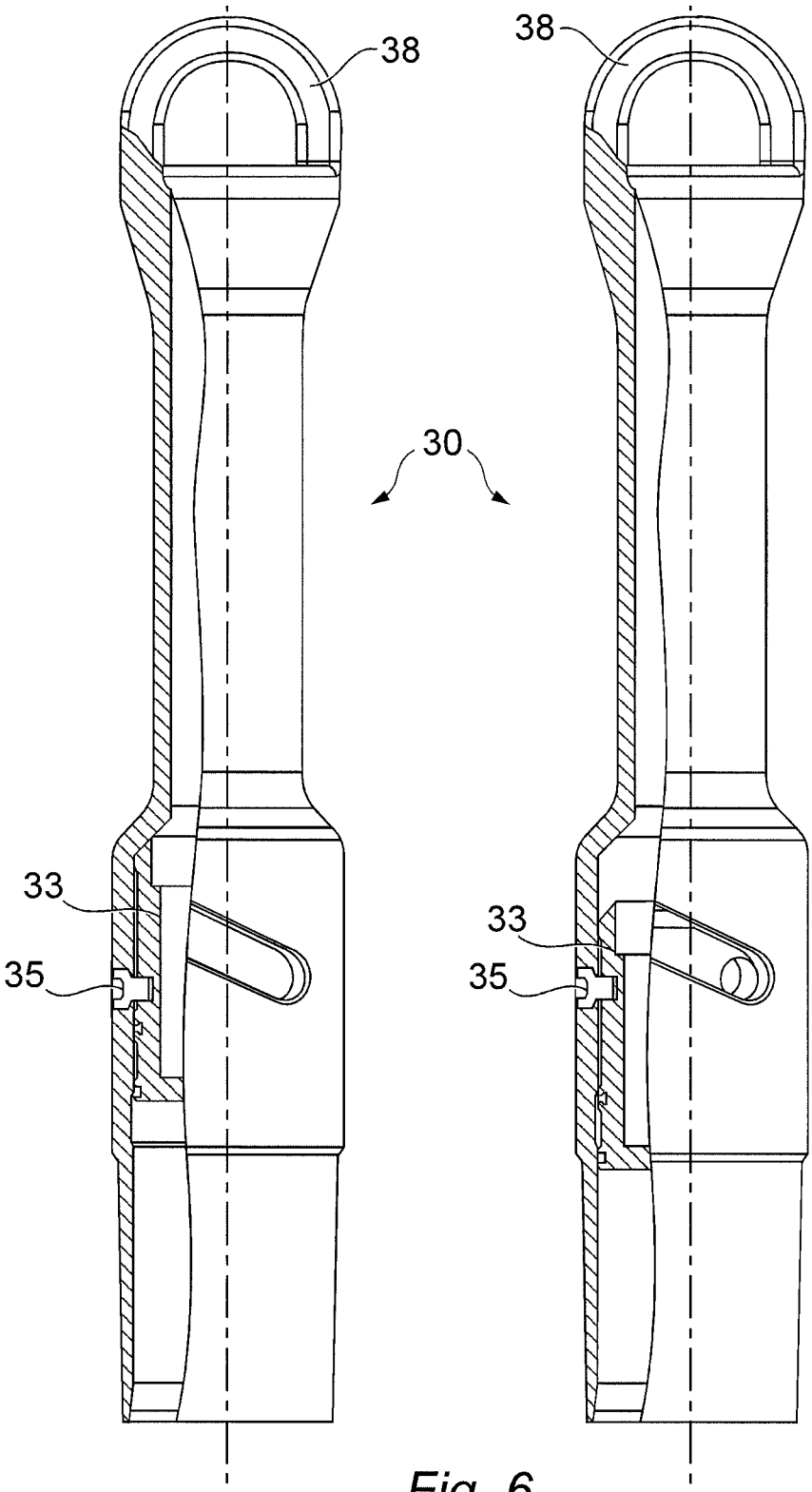
FIG. 6 shows two exemplary embodiments of an open and closed upper sealing means, respectively.

FIG. 6 shows two exemplary embodiments of an open and closed upper sealing means 30, respectively. The upper sealing means 30 to the left in FIG. 6 leaves the drain hole 31 open. The member 33 is in its upper position and does not seal the drain hole 31. The upper sealing means 30 to the right in FIG. 6 seals the drain hole 31. The member 33 is in its lower position and seals the drain hole 31. An index pin 35 may be provided for guiding the movement of the member 33 within the upper sealing means 30.

According to one embodiment, the upper sealing means 30 may seal the top end opening 16 of the inner flow tube 14. By having the upper sealing means 30, when connected to a debris chamber, seal a flow tube 14 within the debris chamber, a lower sealing means 40 may not be necessary.

Figure 7:
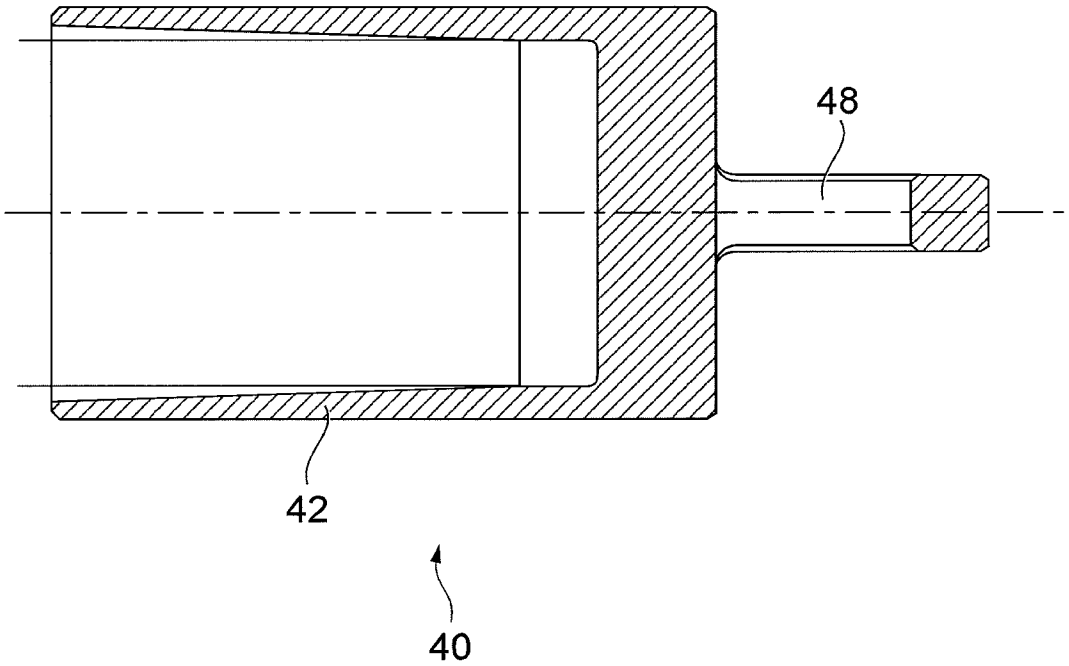
FIG. 7 shows an exemplary embodiment of a lower sealing means.

FIG. 7 shows an exemplary embodiment of a lower sealing means. The lower sealing means 40 may be connectable to a lower end of a debris chamber. This embodiment includes a cylindrical body 42 sealed at one end and open at the other end, the open end being connectable to a top end of the debris chamber 11. The lower sealing means 40 may prevent debris from exiting the debris chamber when connected to the debris chamber.

According to one embodiment, the sealing means 30 and 40 may include a grip for handling the sealing means 30 and 40. The grip may be a lifting end 38 and 48, respectively. The lifting end 38 and 48 may be in the shape of an opening. Such lifting ends 38 and 48 may be suitable for gripping and/or handling a debris chamber when the sealing means 30 and 40 are attached to a debris chamber.

According to one embodiment, the grip may alternatively, or in combination, include an elongated neck 37 suitable for gripping and handling the sealing means 30 and 40. The elongated neck 37 may reach a suitable distance to allow gripping and handling, as illustrated in FIGS. 5 and 6. The lower sealing means may also be provided with such an elongated neck.

By provision of gripping and/or handling means at the sealing means 30 and 40 a debris chamber may be gripped and/or handled. When the debris chamber is filled with debris and/or hazardous fluid, the sealing means isolates the debris chamber and the debris chamber can be gripped and handled without unwanted fluid spillage. The provision of an integral drain valve in the sealing means isolates the fluid in the debris chamber and unwanted fluid spillages can be avoided.

According to one embodiment a system is provided including the sealing means and a modular debris chamber. This system allows handling of debris from debris extraction tools without unwanted spillage. The system may seal the debris chamber by the sealing means and the debris chamber may contain debris, such as heavy brine. According to one embodiment, the system may seal the debris chamber by means of the sealing means and any debris in the debris chamber may be drained from the debris chamber with the sealing means connected to the debris chamber.

In use the debris extraction tool may be pulled from the well and dismantled. The sealing means may be attached to the debris chamber. Upper sealing means 30 may be attached to the topmost debris chamber and lower sealing means 40 may be attached to the bottom of the debris chamber. Thereby any fluid within the debris chamber is contained. The inner tube empties into the well when the debris chamber is raised above the fluid level of the well. This assembly, the debris chamber with the sealing means, may then be laid down on a pipe rack and can be emptied in a safe and controlled manner. The gripping and handling means on the sealing means facilitates such dismantling.

According to one embodiment, a method for dismantling a debris extraction tool, wherein the debris extraction tool comprises a plurality of connected debris chambers, using any one, or both, of the sealing means according to any one of the preceding embodiments may include connecting the sealing means to the topmost debris chamber of the debris extraction tool. Hereafter the topmost debris chamber from the debris extraction tool may be disconnected from the tool string. According to one embodiment, the upper sealing means may be connected to an upper end of the topmost debris chamber after disconnecting the topmost debris chamber from the debris extraction tool. According to one embodiment, the lower sealing means may subsequently be connected to a lower end of the topmost debris chamber. According to one embodiment, this may not be necessary if the upper sealing means seals the inner flow tube. These steps may be repeated during the dismantling of the debris extraction tool so that the content of the plurality of debris chambers is sealed by the sealing means. According to one embodiment, the sealing means may be used for handling the debris chambers. According to one embodiment, the sealing means may be used to drain the debris chambers.

By using the disclosed sealing means, the debris chambers may be isolated and unwanted fluid spillages avoided. Hazardous fluids may be prevented from spillage on the rig floor and from making contact with rig personnel. The embodiments comprising the integral drain valve allows for isolation of unwanted fluid spillages.

The sealing means, system, and method discussed above provide for dismantling a debris extraction tool. Embodiments of the present disclosure may provide the ends and advantages mentioned, as well as others inherent therein. While the invention has been described and is defined by reference to particular embodiments of the invention, such references do not imply a limitation on the invention, and no such limitation is to be inferred. The invention is capable of considerable modification, alteration, and equivalents in form and function, as will occur to those ordinarily skilled in the pertinent arts. The described embodiments of the invention are exemplary only, and are not exhaustive of the scope of the invention. Consequently, the invention is intended to be limited only by the scope of the appended claims, giving full cognizance to equivalents in all respects.

The invention claimed is:

1. A debris extraction tool comprising:

a modular debris chamber, the modular debris chamber including a debris bucket that holds debris, an inner flow tube, a top end, and a bottom end; and a first seal, the first seal comprising:

a body having an open end threadingly engaged with the top end of the modular debris chamber and a closed end directly opposing the open end, the body further including a drain hole proximate the open end;

an inner member; and wherein the inner member of the first seal is configured to shift axially between an open position and a closed position, wherein the inner member in the open position is configured to allow a flow of the debris through the drain hole, and wherein the inner member in the closed position is configured to close the drain hole.

2. The debris extraction tool of claim 1, wherein the first seal further comprises:

an index pin attached to the body of the first seal and coupled to the inner member of the first seal, wherein the index pin is configured to guide movement of the inner member with respect to the body between the open position and the closed position.

3. The debris extraction tool of claim 2, wherein:

the inner member of the first seal comprises:

a manual operation hole; and the body of the first seal comprises:

a slot that corresponds with the manual operation hole such that the manual operation hole is exposed.

4. The debris extraction tool of claim 3, wherein the slot of the body of the first seal is oriented such that the inner member of the first seal is configured to manually shift axially and linearly between the open position and the closed position.

5. The debris extraction tool of claim 3, wherein the slot of the body of the first seal is oriented such that the inner member of the first seal is configured to manually shift axially and rotationally between the open position and the closed position.

6. The debris extraction tool of claim 1, wherein the first seal further comprises:

at least one o-ring disposed between an outer diameter of the inner member and an inner diameter of the body.

7. The debris extraction tool of claim 1, wherein the first seal further comprises:

a handle proximate the closed end of the first seal.

8. The debris extraction tool of claim 1, further comprising:

a second seal, the second seal including a body having an open end threadingly engaged with the bottom end of the modular debris chamber, and a closed end directly opposing the open end.

9. The debris extraction tool of claim 7, wherein the second seal further comprises:

a handle proximate the closed end of the second seal.

10. A method comprising:

extracting debris from a wellbore using a debris extraction tool;

removing the debris extraction tool from the wellbore;

threadingly engaging a first seal with a top end of the debris extraction tool, wherein the first seal comprises:

a body having an open end and a closed end directly opposing the open end, the body further including a drain hole proximate the open end; and an inner member; and shifting the inner member of the first seal from an open position to a closed position, the inner member closing and sealing the drain hole in the closed position.

11. The method of claim 10, further comprising:

transporting the debris extraction tool from a rig floor to a disposal area.

12. The method of claim 11, further comprising:

shifting the inner member of the first seal to the open position when the debris extraction tool is at the disposal area; and draining the debris through the drain hole of the first seal.

13. The method of claim 11, wherein the transporting from the rig floor to the disposal area comprises:

lifting the debris extraction tool by a handle of the first seal, wherein the handle of the first seal is proximate the closed end of the first seal.

14. The method of claim 10, further comprising:

threadingly engaging a second seal with a bottom end of the debris extraction tool, the second seal including an open end and a closed end.

15. The method of claim 14, wherein the transporting from the rig floor to the disposal area comprises:

lifting the debris extraction tool by a handle of the second seal, wherein the handle of the second seal is proximate the closed end of the second seal.

* * * * *